United States Patent [19]

Dunn et al.

[11] 4,222,699

[45] Sep. 16, 1980

[54] TOOL SUPPORTING ARM AND MOUNTING PLATE WITH A PLURALITY OF QUICK DISCONNECT MOUNTS FOR MULTIPLE ARMS

[75] Inventors: Robert E. Dunn, Catonsville, Md.; Edward H. Smith, Plum Borough, Pa.

[73] Assignee: Westinghouse Electric Corp., Pittsburgh, Pa.

[21] Appl. No.: 960,363

[22] Filed: Nov. 13, 1978

[51] Int. Cl.[2] ..... B25J 9/00

[52] U.S. Cl. ..... 414/750; 165/76; 228/45; 414/744 A; 414/680

[58] Field of Search ..... 228/45; 29/723, 401 R, 29/157.3 C; 414/146, 680, 743, 750, 744; 165/76

[56] References Cited

U.S. PATENT DOCUMENTS 3,934,731 1/1976 Muller et al. ..... 165/76 X 4,148,403 4/1979 Riffe ..... 414/2

*Primary Examiner*—Milton S. Mehr

*Attorney, Agent, or Firm*—L. A. DePaul

[57] ABSTRACT

A tool support arm 22 is mounted to a plate member 18 which in turn is mounted to a horizontal rotatable table 16. The plate 18 has, on its upper face, a plurality of horizontally extending tool support sleeves 20, each sleeve cooperating with one of the horizontally extending tool support arms for secure engagement and quick release therebetween. The sleeve includes means 40, 48 for indexing the tool arm therein. The tool support arms are intermediately hinged 28 for pivotal movement in a vertical plane to lower the vertical projecting tool supported thereon to a non-interfering inactive position while the active tool on another tool support arm extending horizontally from the plate is in the active, raised position.

6 Claims, 3 Drawing Figures

TOOL SUPPORTING ARM AND MOUNTING PLATE WITH A PLURALITY OF QUICK DISCONNECT MOUNTS FOR MULTIPLE ARMS

BACKGROUND OF THE INVENTION

1. Field of the Invention

This invention relates to a tool support mounting plate having a plurality of tool support arms extending therefrom for use in a remotely controlled automatically operated tool positioning apparatus and more particularly to such a tool support mounting plate having quick disconnect capabilities for changing the tool support arms thereon and wherein the arms are swingable to a non-interfering, at-rest position while supported on the plate.

2. Description of the Prior Art

In refurbishing the internal structure of nuclear steam generators, apparatus for supporting and automatically positioning the necessary tools is temporarily secured within the channel head of the steam generator. The purpose of the automatic remote apparatus is to minimize the presence of personnel within the irradiated steam generator to do the necessary operations previously manually done in refurbishing non-nuclear steam generators. However, the necessary occasional changing of the specialized tools on the remote apparatus requires the manways in the channel head to be opened and the apparatus positioned for manual access to the tool holding apparatus. In view of the fact that at least one tool (e.g. a cleaning brush) is required for use prior to a welding operation and subsequent to a welding operation, it is apparent that if the wire brush and the welding tool could be simultaneously supported by the supporting and positioning apparatus within the channel head, the manway would not have to be opened to change from the brush to the welder and back again. Thus supporting multiple tools for sequential operation within the nuclear steam generator would aid in minimizing personnel exposure to the interior of the generator.

SUMMARY OF THE INVENTION

This invention provides a plate to be supported on a horizontal rotatable table of an automatic tool support and positioning apparatus. The plate supports a plurality of tool arms extending generally radially therefrom in a horizontal plane with tools projecting upwardly from the distal end of each arm for accomplishing a specific operation on the interior structure of a steam generator. The support plate has a plurality of axially horizontally projecting sleeves providing quick disconnect and attachment mechanism for receipt therein of a plurality of tool arms. Each tool arm is hinged at an intermediate point along its horizontal extent to permit pivotal movement in a vertical plane so that the inactive tools can be moved to a lower position than the active tool so as not to contact the internal generator structure.

DESCRIPTION OF THE PREFERRED EMBODIMENT

Figure 1:
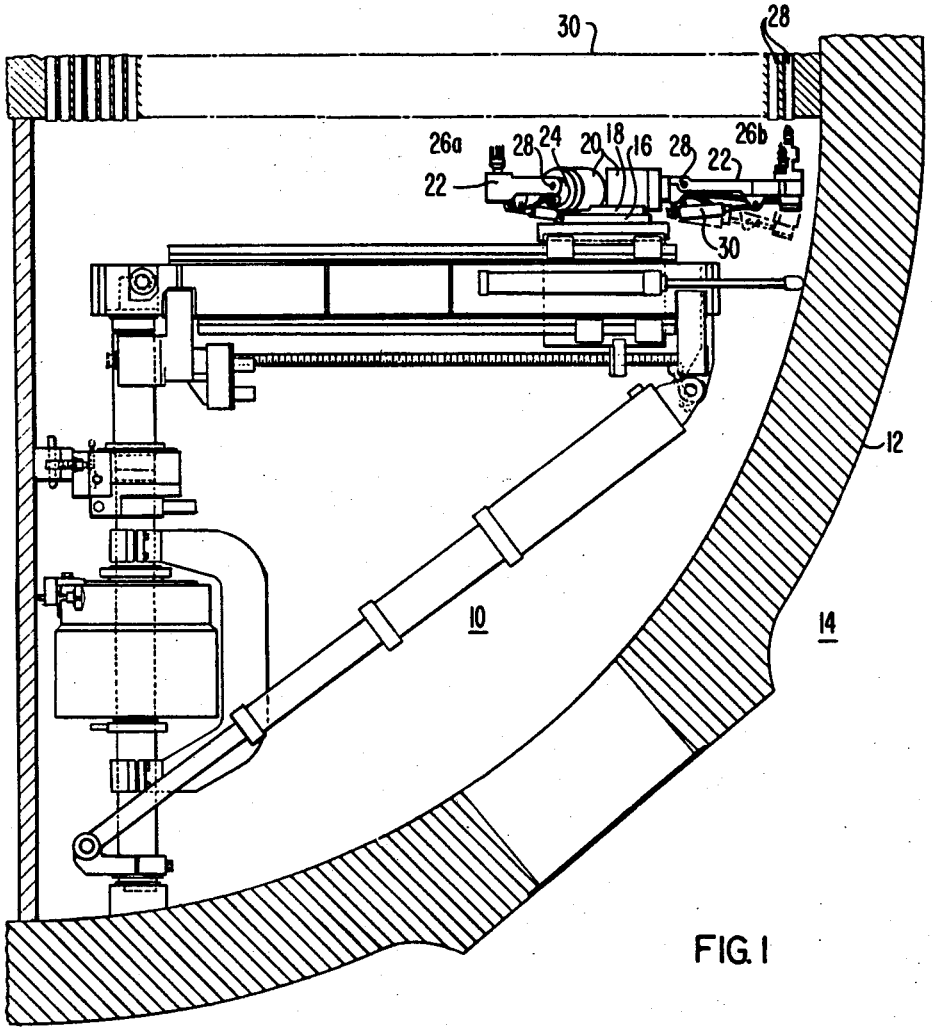
FIG. 1 is a partial sectional view of a steam generator head with remotely operated tool support and positioning apparatus having multiple tool support arms attached according to the present invention.

Referring to FIG. 1, the invention is shown as a part of an automatically operated tool support and positioning mechanism 10 remotely disposed within the channel head 12 of a steam generator 14. Such automatic tool support and positioning mechanism 10 is more fully disclosed in commonly assigned, copending patent application Ser. No. 896,530, filed Apr. 4, 1978, which is herein incorporated by reference to the extent that the operation of a rotatable and vertically movable plate 16 therein described is necessary for showing the proper environment of the present invention. Such plate 16 supports the mounting plate 18 of the present invention as through the expando-pins 19 referred to in the above-referenced application.

Figure 2:
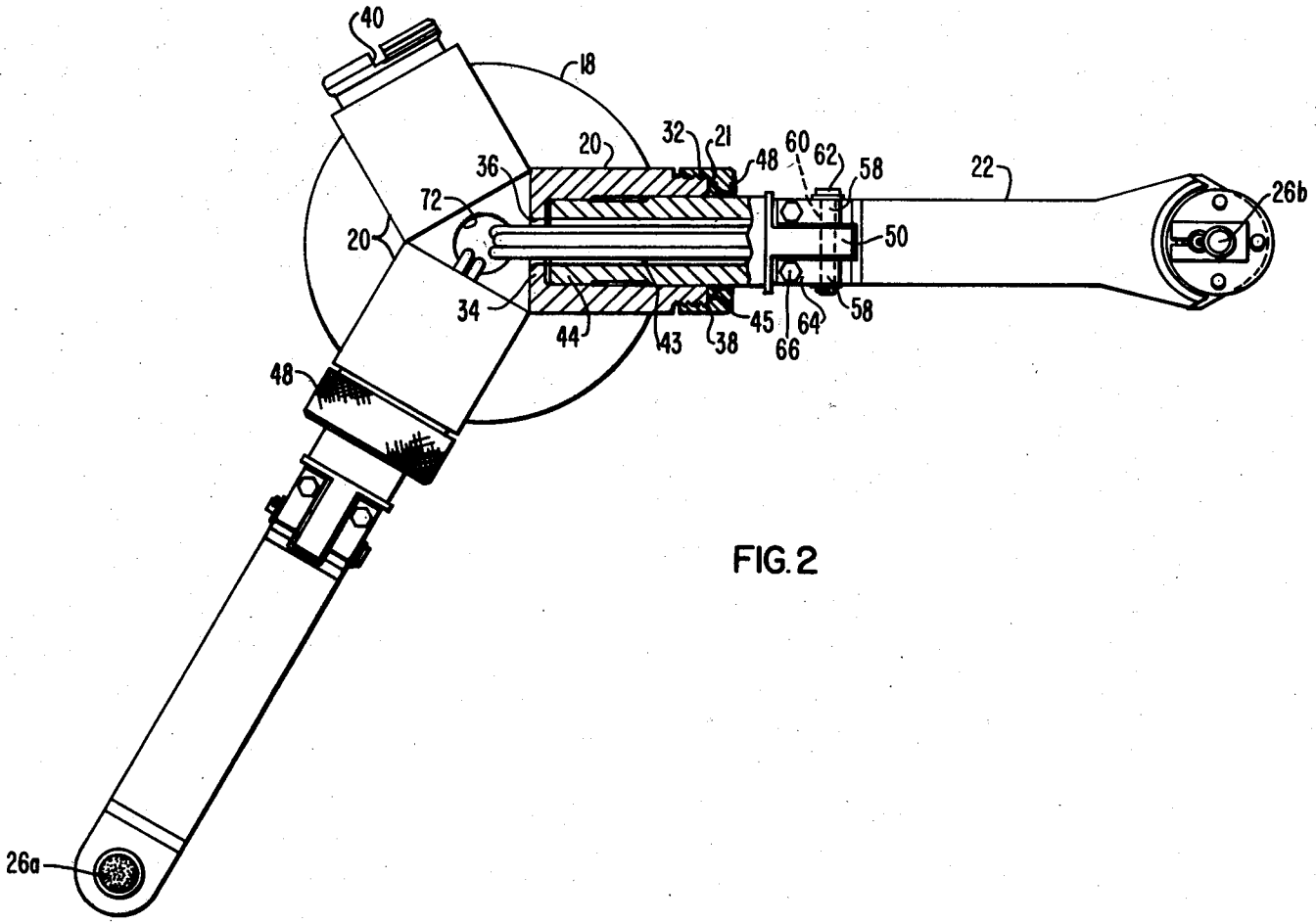
FIG. 2 is a top plan view of a portion of the tool support arm and a quick disconnect mounting structure with portions broken away.

As shown in FIG. 1, the plate 18 of the present invention has mounted thereon, as by welding, a plurality of horizontally extending cylindrical sleeve members 20 (two such sleeves appearing in this view; however, more sleeves can be included as shown in FIG. 2). The sleeves are open at their outer end 21 with the horizontal axis of each sleeve 20 extending generally radially with respect to the plate 18. A tool support arm 22 has one end telescopically received within the sleeve 20 in a quick disconnect mounting arrangement to be explained, and supports a pneumatically or electrically operated tool 26 projecting upwardly therefrom to accomplish the appropriate operation on the tubes 28 or tube sheet 30 of the steam generator. The specific tools shown in FIG. 1 include a rotatable wire brush **26*a* projecting from one arm to brush the tube sheet and tube of the steam generator in preparation for welding the two together, and a welding tool 26*b* projecting from the other arm for effecting the weld between the tube and tube sheet. It is noted that when one of these two tools is elevated to its active position for engagement with the tube and tube sheet, the inactive tool must be retracted to a lower position so as not to interfere. Thus, the tool arms 22 have an intermediate hinge 28 for pivoting either arm, under the influence of an air cylinder 30, from the horizontal to retracted position, as shown in dotted line view in FIG. 1**, the back as desired.

Referring now to FIG. 2, the quick disconnect mounting arrangement for the support arm 22 to the cylindrical sleeve 20 is shown. As therein seen, the cylindrical sleeve 20 is externally threaded as at 32 in a reduced outer diameter area adjacent the open outer end 21. The internal diameter of the sleeve 20 has a slightly stepped configuration with the diameter adjacent the end wall 34 being slightly less than the inner diameter of the remaining portion of the sleeve. The end wall 34 also contains a central aperture 36 therethrough for the passage of air-lines and electrical lines for the tool and tool arm as described later. The peripheral lip 38 defining the open end 21 contains a plurality of radially extending indexing notches 40 for proper orientation of the tool arm 22 therein.

The end of the tool support arm 22 opposite the tool 26 defines a cylindrical stem portion 44 dimensioned to have a close tolerance fit within the cylindrical sleeve 20. Thus the stem portion 44 has an initial diameter generally equal to the inner diameter of the cylindrical sleeve adjacent the wall 34, an intermediate length of reduced diameter, and terminates in a slightly larger diameter generally equal to the inner diameter at the open end 21 of the sleeve 20. With this configuration the stem portion 42 is generally easily inserted in the sleeve and yet provides close tolerance engagement only upon the final inward movement to seat the stem portion within the sleeve. A collar member 45 encircles the cylindrical stem portion 44 and is welded thereto so as to abut the rim 38 of the sleeve 20 when the stem portion is properly seated therein. Pin members 48 (see FIG. 3) extend outwardly from the stem portion adjacent the internal face of the collar 45 for receipt in the notches 40 of the sleeve to ensure that the tool arm 22 is properly oriented within the sleeve 20. An internally threaded knurled collar member 48 is rotatably disposed on the stem portion 44 outwardly of the collar 45 and has an internal face for abutting the collar 45 such that once threaded onto the threads 32 of the sleeve and hand tightened, the stem portion 44 is seated and retained within the cylindrical sleeve 20. Thus, by merely manually screwing the collar member 48 onto the sleeve 20, the arm 22 is secured to the table 18 and is readily disconnected by merely manually unscrewing the collar member and pulling the stem portion 44 out of the sleeve.

Figure 3:
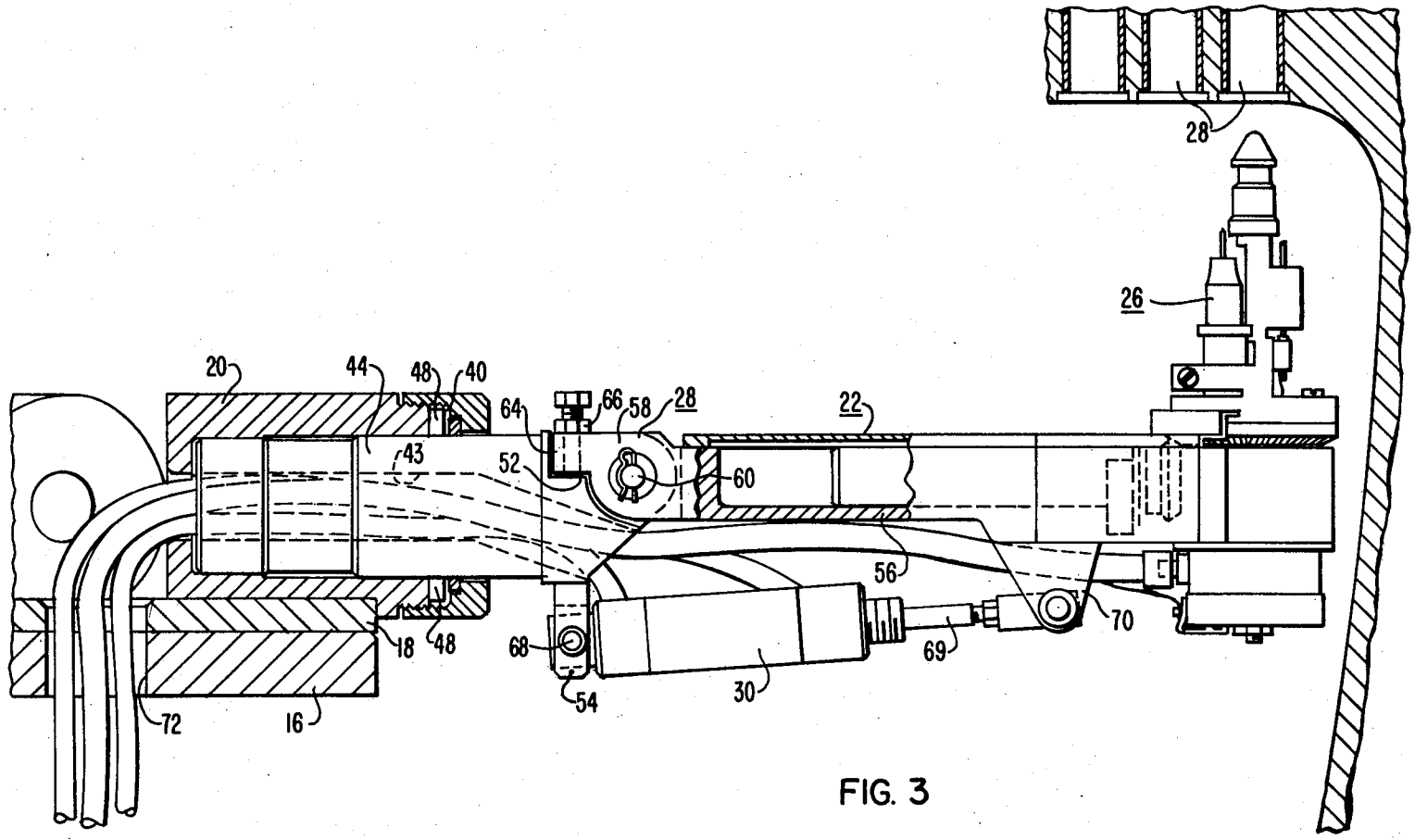
FIG. 3 is a side elevational view of one tool support arm and mounting structure according to the present invention.

As shown in FIG. 2 in conjunction with FIG. 3, the stem portion 42 has an axially extending bore 43 therethrough to permit the passage of the electrical and pneumatic lines necessary for the operation of the tool and the retraction of the tool arm. Also it is seen that the stem portion 44 of the arm terminates in an axially outwardly extending knuckle portion 50 forming a part of the hinge 28. The knuckle portion 50 has spaced horizontal planar shoulder areas 52 on either side thereof and recessed from the upper surface of the knuckle portion 50. A depending integral projection 54 extends downwardly from the bottom face of the terminal end of the stem portion for a purpose to be explained. The support arm 22 is seen to include an outwardly horizontally extending portion 56 separate from the stem portion with the outermost end thereof supporting the upwardly projecting tool 26. Portion 56 of arm 22 is hingedly attached to the stem portion 44 for hinged movement in a vertical plane through a pair of opposed spaced tab members 58 disposed on opposite sides of the projecting knuckle portion 50 and having concentric horizontal apertures 60 therethrough which in turn are concentric with an aperture through the knuckle portion for common receipt of a hinge pin 62. Fingers 64 on the tab members 58 project into the depressed shoulder areas 52 and set screws 66 are vertically threaded therethrough for abutment with the shoulders 52 to establish a proper indexed horizontal position of the extending member 56 when pivoted to its working position.

An air cylinder 30 is hingedly attached, as by pins 68 to the downwardly projecting member 54 on the stem portion 44 and another downwardly projecting member 70 on the underside of the extending portion 56 generally adjacent to tool 26. The air cylinder 30 has an extensible-retractable rod 69 which in its extended position rotates the extended arm portion 56 to its horizontal working position and in the retracted position lowers the arm 56 so that tool 26 does not engage the tube or tube sheet.

Thus, a plurality of tool support arms are in turn supported on common table, with the tools support arms being quickly attached or disconnected from the table. The tool arms mounted on the table are pivotally movable to an inactive position where they do not interfere with the proper positioning of the active tool. Further it is contemplated, although not made a part of the present invention, that the air-lines and electrical lines providing power to the tool 26 and the air cylinder 30 of the retractable arm portion have quick disconnect means generally adjacent the tool support table 18 such that when the tool support arm is connected or disconnected from the sleeve 20 such lines can be readily threaded through the aperture 36 in the sleeve and through a central aperture 72 in the plate 18 to their point of connection.

We claim:

1. Remotely operated multiple tool support apparatus comprising:

plate means for support on a remotely operated variably positionable table, said plate means having means for supporting a plurality of remotely operated tools, said last named means comprising:

a plurality of cylindrical sleeve members secured to said plate means with the axis of each member being horizontal and projecting radially from said plate means;

a plurality of tool supporting arms, each arm having a remotely operated tool on one end and an opposite end configured to be generally tightly telescopically received in said sleeve member; and wherein said member and said arm have cooperating indexing means for positioning said tool in a vertically oriented position when said arm is properly received within said sleeve; and, means for releasably securing said opposite end of said arm within said sleeve member; wherein, said supporting arms include an intermediate hinge means connecting said one end to said opposite end for movement of said one end in a vertical plane from an active axially horizontal position to an inactive lower position; and means for moving said one end between said two positions and maintaining said one end in said active position.

2. Structure according to claim 1 wherein said means for releasably securing said arm within said sleeve comprises:

said sleeve having external threads and an internally threaded collar means freely encircling said arm adjacent said opposite end and engaging structure on said arm for preventing said collar from sliding off said opposite end;

whereby when said opposite end is received within said sleeve said collar member is threaded onto said sleeve.

3. Structure according to claim 2 wherein said cooperating indexing means comprises a notch in the outwardly facing rim of said sleeve member and a pin projecting outwardly from said opposite end of said arm for receipt in said notch when properly positioned within said sleeve.

4. Structure according to claim 1 wherein said means for moving said one end of said arm between said horizontal and said lower position comprises an air cylinder and piston means, one end of which is attached to said opposite end of said arm and the other end connected to said one end of said arm with said piston movable from an extended position corresponding to said horizontal position of said arm to a retracted position corresponding to said lowered position of said arm whereby said multiple tools can be maintained in a lowered non-interfering position and elevated to the active position.

5. Structure according to claim 4 wherein said hinge includes adjustable means for establishing said horizontal position when said piston is in said extended position.

6. Structure according to claim 5 wherein said opposite end of said arm has an axially extending aperture therethrough for passage of air-lines to said air cylinder and said tool therethrough.

* * * * *